US007335073B1

(12) United States Patent
Christian

(10) Patent No.: US 7,335,073 B1
(45) Date of Patent: Feb. 26, 2008

(54) APPARATUS AND METHOD FOR SECURING AN OUTBOARD BOAT MOTOR DURING TRANSIT

(76) Inventor: Greg Christian, 6216 Silver Creek Azle Rd., Azle, TX (US) 76020

( * ) Notice: Subject to any disclaimer, the term of this patent is extended or adjusted under 35 U.S.C. 154(b) by 0 days.

(21) Appl. No.: 11/652,460

(22) Filed: Jan. 11, 2007

(51) Int. Cl.
*B63H 20/08* (2006.01)
*B63H 19/00* (2006.01)
*F16M 1/00* (2006.01)

(52) U.S. Cl. ..... 440/53; 440/113; 248/642

(58) Field of Classification Search ..... 440/53
See application file for complete search history.

(56) References Cited

U.S. PATENT DOCUMENTS 4,501,561 A 2/1985 Speelman ..... 440/61
4,650,427 A * 3/1987 Huchinson ..... 440/55
4,685,888 A 8/1987 Brewer ..... 440/53
4,842,239 A 6/1989 Kinsey et al. ..... 248/640
5,031,842 A 7/1991 Mohr ..... 248/640
5,393,251 A * 2/1995 Gilbert ..... 440/59
5,609,506 A 3/1997 Williams, Jr. ..... 440/53
5,647,781 A * 7/1997 Johnson, Sr. ..... 440/53
6,076,796 A * 6/2000 Huggins et al. ..... 248/640
6,540,571 B1 4/2003 Tolbert ..... 440/53

* cited by examiner

*Primary Examiner*—Jesús D Sotelo
(74) *Attorney, Agent, or Firm*—Charles D. Gunter, Jr.

(57) ABSTRACT

This invention relates to a method to an apparatus and method for securing an outboard boat motor during transportation. More particularly the invention is directed towards a removable support mount capable of attaching to the hydraulic trim cylinders mounted on the transom of a boat. Once attached, the opposite end of the support mount rests beneath the motor keeping it away from the transom in a tilted upward position in order to avoid contact with the road or objects on the road during transportation.

14 Claims, 2 Drawing Sheets

APPARATUS AND METHOD FOR SECURING AN OUTBOARD BOAT MOTOR DURING TRANSIT

BACKGROUND OF THE INVENTION

1. Field of the Invention

The present invention is directed towards a removable support mount of the type which can be used to support an outboard motor in a tilted upward position away from its associated boat transom in order to avoid contact with the road or objects on the road during transportation.

2. Description of the Prior Art

A "motorboat" is generally understood to mean a vessel other than a sailboat or personal watercraft, propelled by an internal combustion engine driving a jet or a propeller. Historically, motorboats have been designed to be used in a variety of activities, such as to pull water skiers, to operate as patrol boats, and to generally support recreational marine driving and fishing activities. The engine, or powerplant, used to propel the boat through water is installed at the rear, or "transom," of the motorboat.

There are three popular variations of powerplants used in motorboats at the present time: inboard, inboard/outboard, and outboard. If the engine is installed within the boat, it is referred to as an inboard motor; if the engine is a removable module attached to the boat, it's commonly known as an outboard motor. An outboard motor is installed on the rear of a boat and contains the internal combustion engine, the gear reduction, and the propeller. An inboard/outboard is a hybrid of an inboard and an outboard motor, where the internal combustion engine is contained inboard and the gear reduction and propeller are outside.

In addition to providing propulsion, outboard motors provide steering control, as they are designed to pivot over their mountings and thus control the orientation of the propeller. The propeller is located at the bottom of the transmission leg, and the transmission leg must be long enough to place the propeller at an adequate depth in the water. to provide fluid motion in the surrounding environment. Consequently, this means that the transmission leg is longer than the length of the transom, usually extending one or more feet below the bottom horizontal plane of the boat. In addition to supporting the propeller, the transmission leg in the water also acts as a rudder even when the propeller is not providing power. Most commercial outboard motors at the present time utilize hydraulic tilt and trim cylinders mounted on the transom of the boat, which have output shafts extending from the transom to the motor. The hydraulic tilt and trim cylinders allow the user to raise and lower the motor from the level of the water and also change the angle of the outboard motor underwater.

It often happens that motorboats are stored in areas other than the location of intended use. In order to transport the boat over land to the desired destination, boat trailers are commonly used to hold the boat while in tow behind a vehicle. Due to the length of the transmission leg of the motor, it is necessary to tilt the motor in an upwards position in order to avoid contact of the motor with the road, or objects on the road, during transport. In addition, the motor must be held away from contact with the transom of the boat, or turbulence during transportation could cause damage to both the motor and the transom.

There are a number of prior art references which show devices and methods for securing the motor in an upwardly tilted position for safe transport. For example, U.S. Pat. No. 5,609,506 shows an apparatus that is permanently fixed to the transom of the boat. The apparatus is capable of restraining the free swivelling movement of the motor. However, designs such as this can be complex and cumbersome to operate, as well as provide difficulties in maintenance, or future removal, due to its permanent nature.

Alternatively, the support apparatus can be detachable, as shown for example in U.S. Pat. No. 6,540,571. This reference shows a device for supporting an outboard motor in a tilted position, relative to the transom of a boat, during transportation by trailer. The outboard motor is affixed to a boat's transom by means of a motor mounting bracket. A motor support bracket is interposed between the motor mounting bracket and the outboard motor's drive shaft housing.

One frequently encountered design consists of an arm or rod placed between the trailer and the motor. For example, U.S. Pat. No. 4,685,888 shows a shock arm which is mounted between a trailer and the shaft of an outboard motor attached to a boat. The shock arm includes a lower member rigidly affixed to the trailer frame and an upper member having a V-shaped opening adapted to receive the motor shaft. Between the lower and upper ends of the shock arm is a shock absorber which absorbs the shock of the motor whenever the trailer hits a bump in the road. The shock absorber includes either a spring or a hydroelectric.tilt mechanism to return the compressed shock absorber to its normal position. Historically, rods with similar designs have presented problems once the boat shifts on the trailer, perhaps due to turbulence on the road or general trailer movement during travel. When this happens, the motor is likely to shift along with the boat, and thereby cause the rod to slide away or change position underneath the motor and become ineffective.

In yet another alternative design, a support device can connect the boat body, rather than the trailer, to the outboard motor. For example, U.S. Pat. No. 4,842,239 shows a device to support an outboard boat motor mounted on a boat during transportation, which includes an elongate support shaft adjustable in length, a U-shaped foot connected to one end of the support shaft, and a transverse engagement rod and bracket connected to the opposite end of the support shaft. Similarly, U.S. Pat. No. 5,031,842 shows an adjustable motor support strut extending between the lower unit of an outboard motor and the drain hole in the transom of the boat. A pivoted support member is insertable into the drain hole. A Y-shaped cradle element at the top of the strut member is adapted to receive an intermediate portion of the lower unit of the motor mounted on the transom. However, in this and similar designs it is important to note that the location and type of connection to the transom can create greater stress on the transom itself.

Lastly, U.S. Pat. No. 4,501,561 shows a brace device formed as a rigid member, preferably having all parts integral. The brace device includes an elongate rod which has a bifurcated portion at each end thereof. One portion engages the shaft which supports the hydraulic operators which tilt the outboard drive unit, and the other bifurcated portion engages the forward part of the outboard drive unit.

Despite improvements of the above type in the area of outboard motor supports, a need continues to exist in support mounts of the type capable of securely keeping a motor away from the transom in an upwardly tilted position in order to avoid contact with the road or objects on the road during transport.

A need also exists for such a support mount that is easily attachable as well as removable.

A need also exists for such a support mount which can be securely fashioned to the transom of the boat, thereby eliminating possibilities of disengagement from the motor during transportation.

SUMMARY OF THE INVENTION

It is accordingly the general object of the present invention to provide an improved apparatus to secure an outboard motor from the transom of a boat during transportation. The invention also has as its object to overcome the above-described limitations and other problems associated with the prior art devices of the same general type.

In one form, the support mount of the invention is comprised of a junction bar, pair of cylindrical support arms, and brace block. The junction bar has inner and outer opposed planar sides and is generally rectangular in shape having a pair of relatively short opposing sides and a pair of relatively long opposing sides. A pair of cylindrical support arms are arranged in spaced parallel fashion to extend outwardly from the inner planar side of the junction bar adjacent the short sides thereof. Each of the support arms has an open interior sized to closely receive a respective one of the hydraulic trim cylinder's output shafts to thereby securely mount the support mount on the boat transom.

In one version, the support mount also includes a brace arm which extends from the outer planar surface of the junction bar generally perpendicular to the plane thereof. The brace arm terminates in a brace block configured to engage a mating surface on the engine motor for supporting the motor in a selected angular position with respect to the transom for transport operations.

In another version of the support mount of the invention, the brace block is mounted directly on the outer planar surface of the junction bar, omitting the brace arm. The brace block has a cupped upper surface, and is configured to cradle a mating surface on the engine motor within the cupped upper surface, for purposes of supporting the motor in a selected angular position with respect to the transom for transport operations In both versions of the device, the support mount is attachable and removable from the boat transom by sliding the support arms on and off the output shafts of the boat's hydraulic trim cylinders. The cylindrical support arms have a predetermined length which is selected to support the motor at the preferred selected angular position with respect to the transom. The support mount can be formed as an integral body without moving parts.

The present invention also encompasses an improved method for securing an outboard motor during transport. Once the motor support mount specified above is provided, the motor is raised upwardly and the mount is placed on the hydraulic trim cylinders located on the transom of the boat by sliding the support arms over the hydraulic trim cylinder output shafts. The motor is lowered until it rests against the support block, thereby keeping the motor away from the transom in a tilted upward position which avoids contact with the road or objects on the road during transportation. As mentioned above, the length of the support mount determines the ultimate tilt angle, as well as the distance of the motor from the ground and the distance of the motor from the transom during transport.

In order to remove the motor support mount, the same process is repeated in reverse. The motor is raised upwardly and the support arms are slid off the hydraulic trim cylinder output shafts. Next, the motor is allowed to rotate downwardly in the direction of the boat transom until it comes to a resting position.

Additional objects, features and advantages will be apparent in the written description which follows.

DETAILED DESCRIPTION OF THE INVENTION

Figure 1:
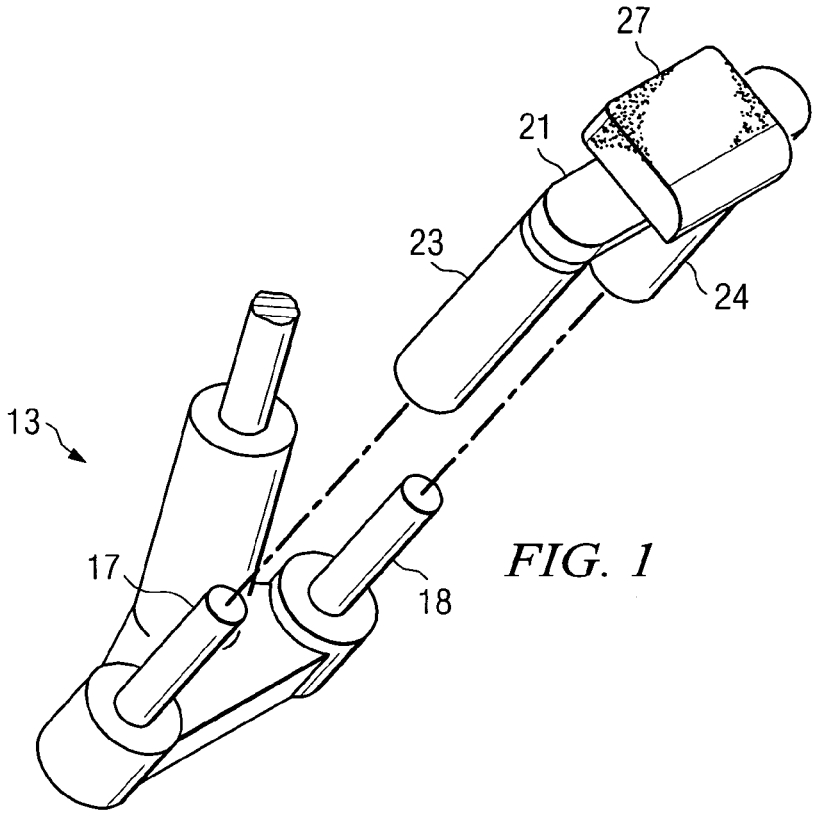
FIG. 1 is a perspective view of an exposed set of hydraulic tilt and trim cylinders capable of receiving the support mount of the present invention.

The discussion which follows uses the term "outboard motor." As mentioned earlier, the term "outboard motor" should be taken to mean a motor that is installed on the rear of a boat and contains the internal combustion engine, the gear reduction, and the propeller. The present invention assumes the motor is for a boat of the type having hydraulic tilt and trim cylinders located on the transom with output shafts extending therefrom which are used to position the motor at various tilt angles. As is conventional in the art, the tilt cylinder 16 is used for tilting the outboard motor upwardly out of and downwardly into the water where the trim cylinders 13 are used for changing the angle of the motor boat engine underwater.

The present invention will now be described with references to FIGS. 1-5, illustrating an outboard motor support mount 19 (FIG. 2) for securing an outboard motor 11 from the transom 15 of a boat during transportation on a trailer. For example, the outboard motor 11 could be one of the many models manufactured by, for example, Yamaha, Evinrude or Johnson; Typically, these engines have shafts that range from 15 to 30 inches in length, with power output ranging from 3 HP to 300 HP, depending on the make, model and pricing.

Figure 2:
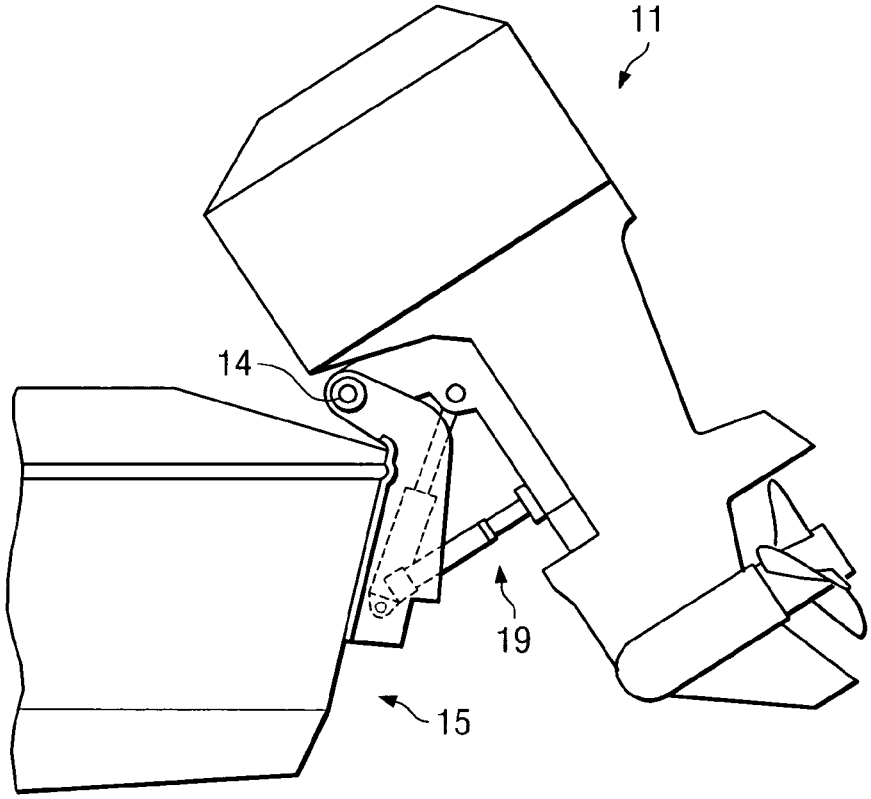
FIG. 2 is a perspective view of the transom of a boat with an outboard motor secured away from the transom in a tilted upward position by a support mount.
Figure 3:
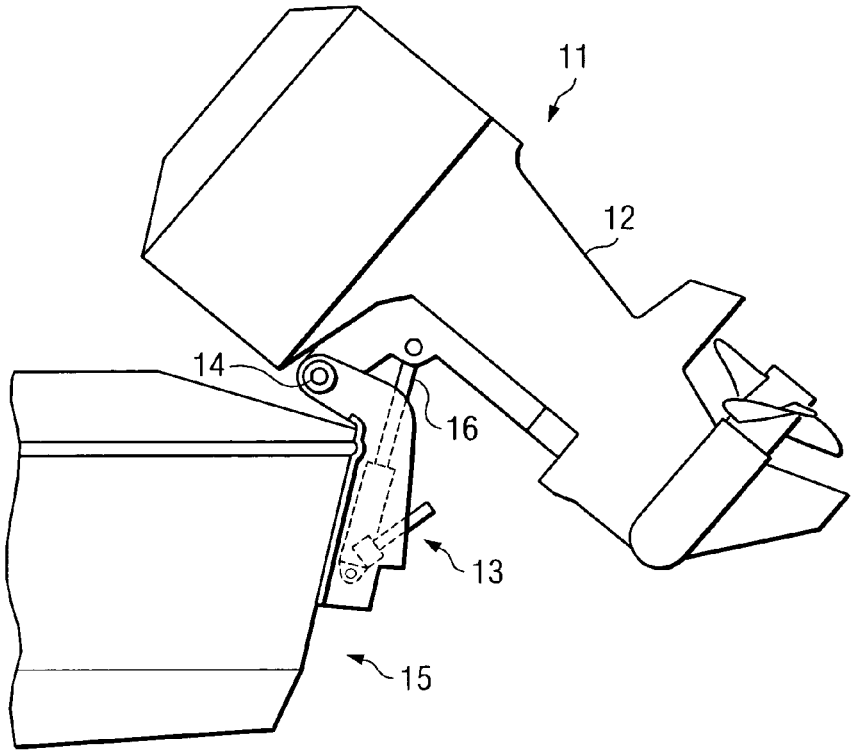
FIG. 3 is a perspective view of the transom of a boat with an outboard motor lifted in an upright tilt from the transom and exposing the hydraulic trim cylinders.

The drawings in FIGS. 1-3 are intended to illustrate the general environment of the present invention. For the purposes of the present invention, the outboard motor 11 is of the general type having hydraulic trim cylinders 13 (FIG. 1) located on the transom 15. The trim cylinders have cylindrical output shafts 17,18 extending therefrom, as shown in FIG. 1. As will be well understood by those skilled in the relevant arts, these hydraulic mechanisms are used to convert hydraulic energy into mechanical energy in the form of translational motion. Hydraulic fluid pumped under pressure from a conventional source acts upon a selected piston chamber to force the respective output shaft to move in or out. In the case of the present invention, the output shafts 17,18, extend outwardly in the direction of the transmission leg 12 (FIG. 3) of the outboard motor 11. When used on the transom 15 of a boat, the hydraulic trim cylinders 13 use the output shafts 17, 18 to adjust the trim of the motor with respect to the transom 15 by either applying or releasing hydraulic pressure to thereby raise or lower the motor 11 respectively. As will be appreciated with respect to FIGS. 2 and 3, the hydraulic trim cylinders 13 move the motor 11 through a range of angles as the motor pivots about the pivot point 14.

Figure 4:
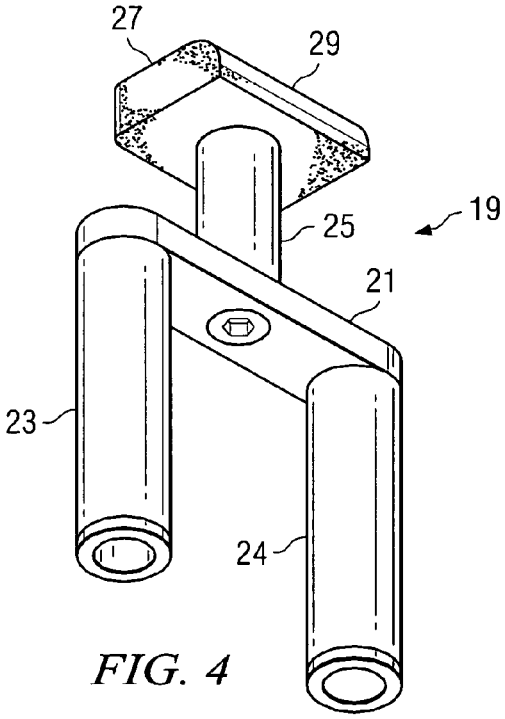
FIG. 4 is a perspective view of one version of the support mount of the present invention.

The various components that make up the motor support mount 19 are perhaps best appreciated with reference to FIG. 4. The support mount 19 can be formed as an integral body without moving parts. Without the inclusion of moving or separate parts, the present invention is sturdy in design and reduces the possibilities of bending or breaking. As shown in FIG. 4, in one version, the motor support mount 19 includes a junction bar 21 having inner and outer opposed planar sides which, in use, lie in planes generally parallel with an exterior plane of the boat transom 15. The junction bar 21 is generally rectangular in shape having a pair of relatively short opposing sides and a pair of relatively long opposing sides. In the embodiment illustrated, the support mount 19 is machined out of aluminum.

Extending outwardly from the inner planar side of the junction bar 21 adjacent to the short sides thereof, a pair of cylindrical support arms 23, 24 are arranged in spaced parallel fashion. Each of the support arms 23, 24 have an open interior sized to closely receive a respective one of the hydraulic trim cylinder's 13 output shafts 17,18 to thereby securely mount the support mount 19 on the boat transom 15. The support mount 19 is attachable and removable from the transom 15 by sliding the cylindrical support arms 23, 24 on and off the cylindrical output shafts 17, 18, as illustrated in exploded fashion in FIG. 1. The cylindrical support arms 23, 24 have a selected length, the length being chosen to support the motor 11 at the desired angular position with respect to the transom 15.

In the embodiment of the invention illustrated in FIG. 1, a brace arm 25 extends from the outer planar surface of the junction bar 21 generally perpendicular to the plane thereof. The brace arm 25 terminates in a brace block 27 configured to engage a mating surface on the engine motor 11 for supporting the motor 11 in a selected angular position with respect to the transom 15 for transport operations. The brace block 27 has a wide planar area 29 that contacts the mating motor 11 surface in order to create stability with more points of engagement than the traditional rod or arm connection.

By attaching to both hydraulic trim cylinder 13 output shafts 17, 18, the support mount 19 provides extra stability, as compared to a single point attachment, for the motor 11. This design eliminates the possibility that the support mount 19 could shift from its attachment point during turbulence experienced while traveling. In addition, the weight of the motor 11 is spread more equally between a broader area of the transom 15, thereby relieving some of the stress inflicted on the transom 15 during transportation and allowing the support mount 19 to act as an auxiliary support to the transom 15.

Figure 5:
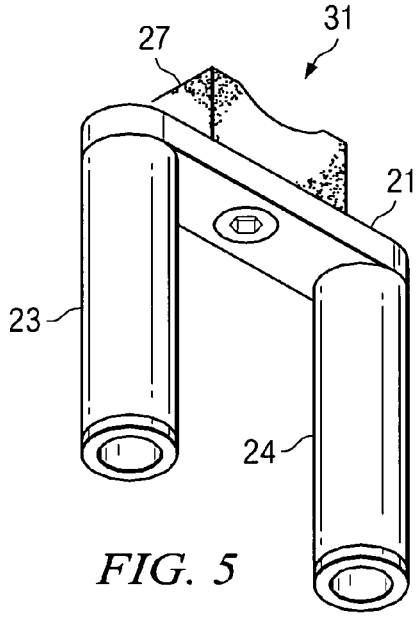
FIG. 5 is a perspective view of another version of the support mount of the present invention.

Another version of the present invention is shown in FIG. 5, wherein the illustrated support mount 19 is intended for use with Mercury motors. The support mount 19 still consists of a junction bar 21, and cylindrical support arms 23, 24. However, this version of the support mount does not have a brace arm, and instead the brace block 27 directly extends from the outer planar surface of the junction bar 21 generally perpendicular to the plane thereof. In addition, the brace block 27 has a cupped upper surface 31 that contacts the mating motor 11 surface in order to create stability by cradling the motor 11 within the confines of the cupped upper surface 31.

In another embodiment of the invention, the support mount 19 can be formed of separate components that are connected by use of flat socket cap screws, or other convenient means.

The operation of the motor support mount 19 of the invention will now be briefly described. FIGS. 1-3 illustrate the method of the invention by outlining the three major steps involved. To begin, the motor 11 is raised upwardly, using the tilt cylinder 16, thereby exposing the output shafts 17, 18 of the hydraulic trim cylinders 13. FIG. 3 is a perspective view of the transom 15 of a boat with an outboard motor 11 lifted in an upright angle from the transom 15 with the hydraulic trim cylinders 13 output shafts 17, 18 exposed underneath. The support mount 19 is placed on the output shafts 17, 18 by sliding the cylindrical support arms 23, 24 over the output shafts 17, 18 until the support mount 19 is firmly in place. Finally, the motor 11 is lowered until the motor 11 rests against the brace block 27. This will keep the motor 11 away from the transom 15 in a tilted upward position and avoid contact with the road or objects on the road during transportation. FIG. 2 is a view of the outboard motor 11 secured away from the transom 15 in a tilted upward position (transit position) by a support mount 19.

The motor support mount 19 is also easily removed from the transom 15 of the boat by following the reverse pattern of steps mentioned above. The motor 11 is raised upwardly and the support mount 19 is removed by sliding the support arms 23, 24 off the hydraulic trim cylinder 13 off the output shafts 17, 18. Next, the motor 11 is allowed to slowly rotate downwardly in the direction of the boat transom 15 until reaching a resting position.

An invention has been provided with several advantages. The support mount securely keeps a motor away from the transom in an upwardly tilted position in order to avoid contact with the road or objects on the road during transport, as well as preventing contact with the motor and the transom. In addition, the support mount is easily attachable as well as removable. The support mount can be securely fashioned to the transom of the boat, thereby eliminating possibilities of disengagement from the motor during transportation. The operation of attaching and removing the support mount to and from the hydraulic trim cylinders is simple in nature, requiring little effort from the user. Due to the point of contact on the transom, the support mount is capable of acting as an auxiliary support to take stress off of the transom. The support mount of the invention is simple in design and economical to manufacture. The support mount is made of readily available materials and components and is of extremely sturdy design.

What is claimed is:

1. An outboard motor support mount capable of securing a motor from the transom of a boat of the type having hydraulic trim cylinders located on the transom with cylindrical output shafts extending therefrom, comprising:

a junction bar having inner and outer opposed planar sides which, in use, lie in planes generally parallel with an exterior plane of the boat transom;

a pair of cylindrical support arms arranged in spaced parallel fashion to extend outwardly from the inner planar side of the junction bar, each of the support arms having an open interior sized to closely receive a respective one of the hydraulic trim cylinder's output shafts to thereby securely mount the support mount on the boat transom; and a brace arm extending from the outer planar surface of the junction bar generally perpendicular to the plane thereof, the brace arm terminating in a brace block configured to engage a mating surface on the outboard motor for supporting the motor in a selected angular position with respect to the transom for transport operations.

2. The support mount of claim 1, wherein the support mount is removable from the boat transom by sliding the support arms off the cylindrical output shafts.

3. The support mount of claim 1, wherein the junction bar is generally rectangular in shape having a pair of relatively short opposing sides and a pair of relatively long opposing sides, the cylindrical support arms extending outwardly from the inner planar surface of the junction bar adjacent the short sides thereof.

4. The support mount of claim 1, the cylindrical support arms have a selected length, the length being selected to support the motor at the selected angular position with respect to the transom.

5. The support mount of claim 1, wherein the support mount is formed as an integral body without moving parts.

6. The support mount of claim 5, wherein the support mount is machined out of aluminum.

7. An outboard motor support mount capable of securing a motor from the transom of a boat of the type having hydraulic trim cylinders located on the transom with cylindrical output shafts extending therefrom, comprising:

a junction bar having inner and outer opposed planar sides which, in use, lie in planes generally parallel with an exterior plane of the boat transom;

a pair of cylindrical support arms arranged in spaced parallel fashion to extend outwardly from the inner planar side of the junction bar, each of the support arms having an open interior sized to closely receive a respective one of the hydraulic trim cylinder's output shafts to thereby securely mount the support mount on the boat transom; and a brace block extending from the outer planar surface of the junction bar generally perpendicular to the plane thereof, the brace block configured to cradle a mating surface on the outboard motor within a cupped upper surface, for purposes of supporting the motor in a selected angular position with respect to the transom for transport operations.

8. The support mount of claim 7, wherein the support mount is removable from the boat transom by sliding the support arms off the cylindrical output shafts.

9. The support mount of claim 7, wherein the junction bar is generally rectangular in shape having a pair of relatively short opposing sides and a pair of relatively long opposing sides, the cylindrical support arms extending outwardly from the inner planar surface of the junction bar adjacent the short sides thereof.

10. The support mount of claim 7, the cylindrical support arms have a selected length, the length being selected to support the motor at the selected angular position with respect to the transom.

11. The support mount of claim 7, wherein the support mount is formed as an integral body without moving parts.

12. The support mount of claim 11, wherein the support mount is machined out of aluminum.

13. A method of securing an outboard motor of a boat connected to the transom of the boat with hydraulic trim cylinders, comprising the steps of:

providing a junction bar having inner and outer opposed planar sides which, in use, lie in planes generally parallel with an exterior plane of the boat transom, the junction bar having a pair of cylindrical support arms arranged in spaced parallel fashion to extend outwardly from the inner planar side of the junction bar, each of the support arms having an open interior sized to closely receive a respective one of the hydraulic trim cylinder's output shafts to thereby securely mount the support mount on the boat transom, the junction bar also having a brace arm extending from the outer planar surface of the junction bar generally perpendicular to the plane thereof, the brace arm terminating in a brace block configured to engage a mating surface on the outboard motor for supporting the motor in a selected angular position with respect to the transom for transport operations;

placing the support mount on the hydraulic trim cylinders located on the transom of the boat, wherein the support mount is slidably attachable and removable; and resting the motor against the support block and thereby keeping the motor away from the transom in a tilted upward position to avoid contact with the road or objects on the road during transportation.

14. The method of claim 13, wherein removing the support mount comprises the steps of:

raising the motor upwardly and removing the support mount by sliding the support arms off the hydraulic trim cylinder output shafts;

allowing the motor to rotate downwardly in the direction of the boat transom to a rest position.

* * * * *